United States Patent [19]

Harris

[11] 3,995,334

[45] Dec. 7, 1976

[54] BED FRAME

[75] Inventor: George M. Harris, Chicago, Ill.

[73] Assignee: Harris-Hub Company, Harvey, Ill.

[22] Filed: Jan. 7, 1976

[21] Appl. No.: 647,207

Related U.S. Application Data

[63] Continuation-in-part of Ser. No. 507,084, Sept. 18, 1974, abandoned.

[52] U.S. Cl. ..... 5/202; 5/181; 5/200 R; 5/310

[51] Int. Cl.[2] ..... A47C 19/00

[58] Field of Search ..... 312/255, 256; 248/188.7; 5/181, 185, 200 R, 201 B, 279 C, 282 R, 286, 292, 310

[56] References Cited

UNITED STATES PATENTS

| | | | |
|---|---|---|---|
| 2,470,397 | 5/1949 | Harter | 248/188.7 |
| 2,553,890 | 5/1951 | Bloch | 248/188.7 |
| 2,851,702 | 9/1958 | Imber et al. | 5/202 |
| 3,555,579 | 1/1971 | Harris | 5/201 |

FOREIGN PATENTS OR APPLICATIONS

| | | | |
|---|---|---|---|
| 759,544 | 2/1957 | United Kingdom | 5/201 |

*Primary Examiner*—Casmir A. Nunberg

[57] ABSTRACT

A bed frame assembly of the knock-down type including a pair of spaced parallel L-shaped side frame members and a pair of parallel L-shaped cross frame members extending perpendicularly between the side frame members with the assembly supported by a plurality of leg members. Each leg member includes a first leg element having an upper portion fixed to the frame by a direct connection and a lower end cantilevered inwardly and downwardly to locate a floor engaging member supported on the lower end entirely inwardly of the side frame member. In one embodiment of the invention, the first leg elements are hollow connected to the cross frame members and telescopingly receive second leg elements connected to the side frame members. In another embodiment the upper ends of the first legs elements are connected directly to the side frame members and are arcuate in cross-section.

24 Claims, 8 Drawing Figures

14
11
5
13
15
12
22
16
17
18
36
34
35
5

20
24
13
14
25
11
23
25

10
12
16
11
11
11
12
16
16

19
22
15
12
26
22
17
18
34
18'
28

11
14
19
23
13
25
12
22
22
20
17
16
24
34
18
36
18'
34
35
27

BED FRAME

REFERENCE TO RELATED APPLICATION

This application is a continuation-in-part application for now abandoned application Ser. No. 507,084, filed Sept. 18, 1974, and assigned to the assignee of the present invention.

BACKGROUND OF THE INVENTION

Knock-down bed frame assemblies of the so called "Hollywood" type are well-known to those skilled in the art. Such structures have conventionally included a plurality of generally L-shaped side and cross frame members detachably secured to one another for supporting a mattress and box spring unit. Usually, these bed frame assemblies are supported by four leg assemblies that are respectively located at the four points of interconnection between the side frame members and cross frame members. In virtually all of the bed frame assemblies presently available, the leg structures extend generally vertically with respect to the side frame members and are located directly below the side frame members so that the caster wheels or other floor engaging members are located directly below the side frames.

According to recent versions of the Hazardous Product Index, based upon reported injuries, beds are rated number four for children under 5 years of age, number seven for all children under 16, and number 10 for women. The large number of injuries from beds results to a large measure from adults and children striking their feet against the legs or casters of the bed frame assembly.

Another problem encountered, for economic reasons, is that bed frame assemblies of the above type have in the past typically been constructed from rerolled rail sections formed into an angle. One shortcoming of this type of steel is that it is work hardened to such a high degree that it is unfeasible to fasten component parts of a bed frame made of such material by means of welding. Instead, bed frames made from rerolled angle iron stock are fastened together by means of rivets or other suitable fasteners. It has been proposed in the past to construct bed frame members of sheet steel materials (see U.S. Pat. Nos. 3,123,837 and 3,646,623), but the leg elements of such bed frames were riveted to the frame since it was thought that this mode of connection was necessary to give the product adequeat strength.

The industry is now presented with the situation where it is economically feasible to manufacture bed frames from sheet stock material. As compared to rerolled rail stock, low carbon sheet steel is not nearly as hard and is quite capable of being welded. From a manufacturing point of view, welding is an advantageous method of constructing bed frames because it eliminates extra ordinary fasteners and the necessity of having to machine connected parts to a high degree of tolerance. However, heretofore, those skilled in the art have been led away from welding as a manufacturing technique because of concern that a welded bed frame would fail once it is subjected to repeated stresses during use.

SUMMARY OF THE INVENTION

The present invention obviates the above problems by providing a leg structure which will position the floor engaging members a substantial distance inwardly and below the side frame members so that it is less likely for a housewife to make contact with the floor engaging members while making the bed.

According to one aspect of the invention, the leg structure is constructed in such a way that the supporting leg elements can also be utilized as a part of the securing means for securing the side frame members to the cross frame members. More specifically, the leg structure of the present invention consists of a plurality of leg elements that are secured to the frame at spaced locations and each leg element has an upper end portion fixed to the frame by a direct connection to locate the upper end below the side frame members. The leg elements are of a sufficient length to locate the lower ends, which each support a floor engaging member, inwardly and downwardly a sufficient distance so that the lower ends are cantilevered inwardly and below the side frame members and the floor engaging member is located entirely inwardly of the direct connection between the leg element and the frame structure.

In one specific embodiment of the invention, the first leg element is hollow and slidably received a second leg element that is fixed to the side frame member while the first leg element is fixed to the cross frame member so that the leg structure not only provides a support for the completed bed frame assembly, but also provides a very simple interconnection between the cross frame members and the side frame members.

In this embodiment of the invention, the respective leg elements and the side and cross frame members are all made of low carbon sheet steel material and the first leg elements are welded to the cross frame members while the second leg elements are welded to the side frame members. The first elements are welded to the cross frame members so as to have an upwardly facing open end that is substantially coplanar with the horizontally disposed surface portions of the cross frame member and positioned to slidably receive the second leg elements that are welded to the side frame members. The second leg elements are welded to the lower surface of horizontal coplanar portions of the side frame members and slide within the first leg elements until the lower horizontal surface portions of the side frame members engage the upper surface of the cross frame member and the upper end of the first leg element.

When this occurs, the side frame members are secured to the cross frame members and are prevented from pivotally moving with respect to the cross frame members because of the particular construction of the leg elements. Further, downward load forces exerted on the side frame members serve to maintain the side frame members in abutting engagement with an upper surface of the cross frame members.

In this embodiment of the invention, the leg elements are rectangular hollow tubular members that extend at an acute angle inwardly from the longitudinal extent of the side of the bed frame. This eliminates the very common and annoying problem of stubbing toes experienced on traditional leg frame members that extend straight downwardly from the side frame members.

In this embodiment of the invention, the bed frame members are preferably welded by weld beads that are positioned in areas of the structure that are subjected to shear forces during use. Specifically, the rectangular leg elements on the cross frame members are disposed at an angle of 45° and positioned in surface abutting engagement with a vertical leg of the cross frame member, with continuous weld beads extending along at least both corners of the leg element and preferably also across the bottom of the vertical leg of the cross frame member. Also, the upper ends of the leg elements on the side frame members are abutted against the lower surface of the horizontal leg thereof and are connected by a continuous weld bead extending around at least two sides of the leg element. It has been found that bed frame structures constructed as described above exhibit remarkable strength, far in excess of what would be expected for a bed constructed of a low carbon sheet steel material.

In a modified form of the invention, a simplified form of leg structure again results in having the floor engaging member located a substantial distance inwardly of the side frame members. In this embodiment of the invention, the leg elements have an upper end portion that is secured directly below the side frame members by a direct connection and each leg element has a lower end supporting a floor engaging member and the intermediate portion of the leg element extends inwardly and downwardly a sufficient distance such that the lower end of the leg element is cantilevered inwardly and below the side frame member to locate the floor engaging member entirely inwardly of the direct connection as well as the side frame member.

As in the previous embodiment, the leg is designed to position the floor engaging member a sufficient distance inwardly from the side frame member to eliminate the common and annoying problem of stubbing toes experienced on traditional leg frames that extend downwardly from the side frame members.

In this embodiment of the invention, the cross frame members and side frame members are preferably interconnected by a bracket structure that is secured directly to an intermediate portion of the leg structure as well as to the side frame member.

As in the previous embodiment, all of the elements can be formed of low carbon sheet material and welded or can alternatively be riveted.

The cantilevered arrangement and the arcuate configuration of the intermediate portion of the leg structures in the alternate embodiment results in giving the bed some "bounce" because of the location of the leg structures with respect to the frame member.

DETAILED DESCRIPTION

Figures 1, 2, 3, 4, 5:
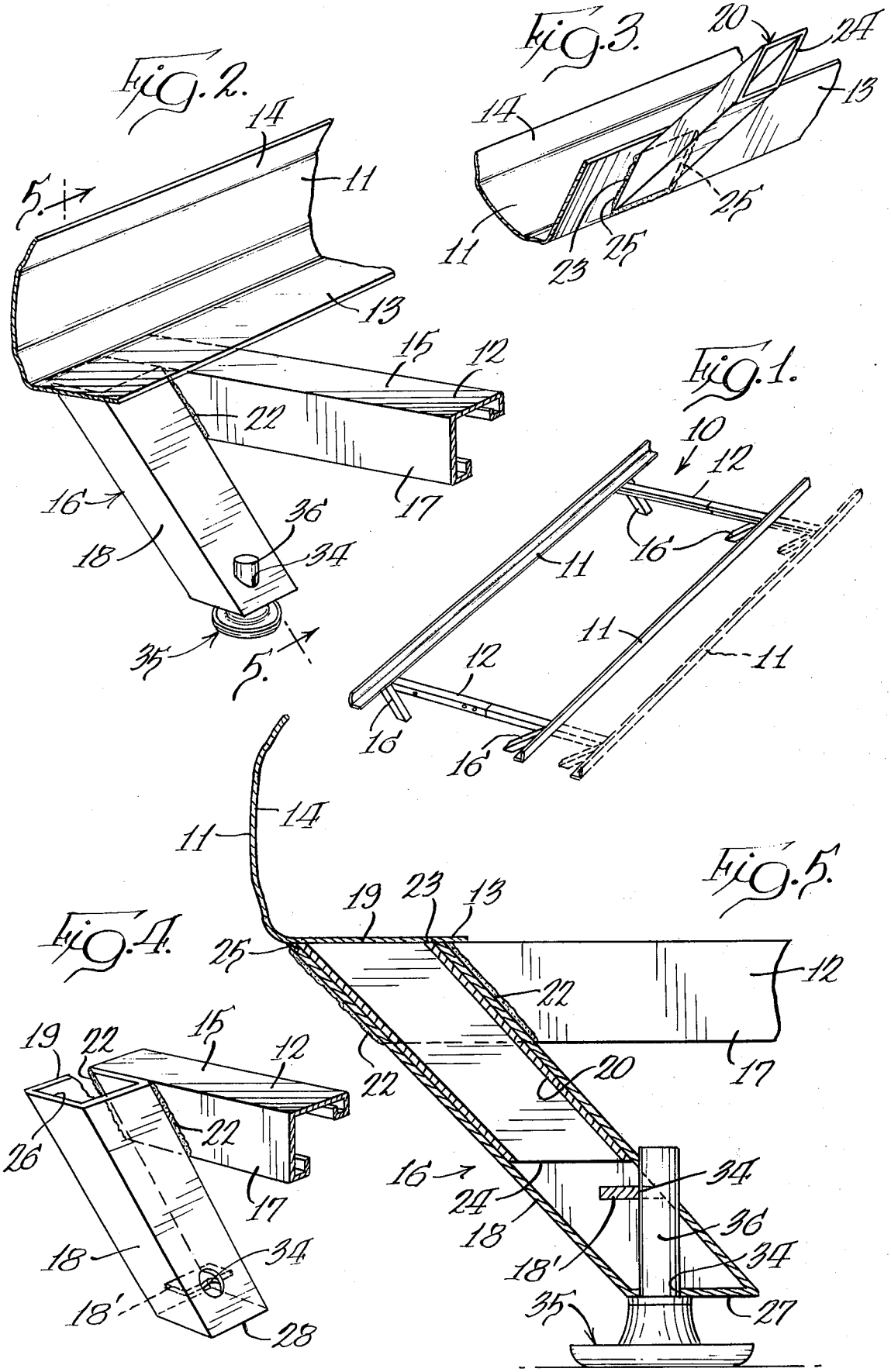
FIG. 1 is a perspective view of a bed frame assembly constructed in accordance with the present invention.
FIG. 2 is an enlarged fragmentary perspective view illustrating the leg members which define the connection means between one side frame member and one cross frame member of the bed frame assembly.
FIGS. 3 and 4 are enlarged fragmentary perspective views of a side frame member and a cross frame member, respectively, illustrating the welded leg elements.
FIG. 5 is a sectional view taken along line 5—5 of FIG. 2.

While this invention is susceptible of embodiment in many different forms, there is shown in the drawings and will herein be described in detail, preferred embodiments of the invention, with the understanding that the present disclosure is to be considered as an exemplification of the principles of the invention and is not intended to limit the invention to the embodiments illustrated. The scope of the invention will be pointed out in the appended claims.

Referring now to the drawings in detail, a bed frame assembly 10 is shown in FIG. 1 comprising a pair of spaced parallel elongated side frame members 11 spanned by a pair of spaced parallel cross frame members 12 extending generally perpendicular with respect to the side frame members 11. Side frame members 11 are elongated generally L-shaped sheet metal members having horizontal inwardly facing coplanar leg portions 13 adapted to receive on the upper surface thereof a box spring and mattress, and a generally vertically extending leg portion 14 adapted to confine the box spring and mattress on the coplanar portions 13. Cross frame members 12 are generally the same as those illustrated in above-mentioned U.S. Pat. No. 3,646,623 and also are generally L-shaped sheet steel members with horizontal coplanar portions 15 and downwardly extending vertical portions 17. Cross frame members 12 extend generally perpendicular with respect to side frame members 11 with horizontal coplanar portions 15 positioned immediately below the horizontal surface 13 of side frame members 11 when the frame is assembled.

Side frame members 11 are detachably secured to cross frame members 12 by connecting means which will be discussed in detail below. The frame 10 is supported above the floor by four leg members 16 which extend downwardly and inwardly at an angle with respect to the longitudinal extent of side frame members 11 and which carry floor engaging members 35. Each leg member 16 is formed of a first leg element 18 secured to cross frame member 12 and a second leg element 20 secured to side frame member 11.

Each first leg element 18 is a sheet metal member rolled into a hollow rectangular open box configuration of uniform dimension throughout its length. Each element 18 has an upwardly facing open upper end 26 and a closed lower end 27 which define, respectively, parallel plane surfaces 19 and 28 disposed at an acute angle with respect to the longitudinal axis of element 18. Referring to FIGS. 4 and 5, an upper portion of an outer side surface of leg element 18, adjacent upper end 26, is positioned in surface abutting engagement with the vertical leg 17 of cross frame member 12 at the end thereof, and is connected by a weld to the cross frame member at an acute angle which is the same as the angle formed between the end surface portion 19 of the leg element 18 and the longitudinal axis thereof. End surface portion 19 of leg element 18 is arranged to be substantially level with the upper horizontal leg 15 of cross frame member 12, and the end of the cross frame member is beveled, as can be best seen in FIG. 5, so as to be disposed substantially in the same plane as the outer side of leg element 18. Leg elements 18 have their upper portions fixedly connected to the cross frame members by weld beads 22 which extend continuously along the side edges of the leg element in contact with the cross frame member to define a direct connection. For added strength, the lower edge of vertical leg 17 may also be welded to the adjacent surface of the leg element.

As clearly shown in FIG. 5, upper end 23 of leg element 18 is located entirely below horizontal leg 19 of side frame member 11. Also, leg elements 18 extend downwardly and inwardly a sufficient distance so that each lower end is cantilevered inwardly and below side frame members 11 and floor engaging member 35 is located entirely inwardly of the direct connection between cross frame member 12 and leg element 18.

Each side frame member 11 is detachably secured to a cross frame member 12 and first leg element 18 by means of a further leg element 20 slidably receivable within open end 26 of the leg element 18. Second leg element 20 is a sheet metal member rolled so as to be similar in shape to leg element 18. In this regard, second leg element 20 is of open-box rectangular configuration of uniform dimension throughout its length with parallel end surface portions 23 and 24 formed at the same acute angle with respect to the longitudinal axis of element 20 as parallel end surfaces 19 and 28 are angled with respect to the longitudinal axis of element 18. End surface 23 of leg element 20 is positioned in surface abutting engagement with the lower surface of horizontal leg 13 of side frame member 11, and element 20 extends downwardly at an acute angle with respect to the horizontal identical to the angle at which leg 16 extends with respect to the horizontal. Leg element 20 is welded to the lower surface of horizontal flange 13 by a bead line 25 which preferably extends continuously along at least two sides of the leg element. For added strength, the weld bead may extend around three, or all four sides of the leg element.

Second leg element 20 is smaller in cross section than first leg element 16 and is slidably receivable therein to connect the side frame and cross frame members. First leg element 18 is longer than second leg element 20 (see FIG. 4), so that leg element 20 will slide entirely within leg element 18 until the lower surface of the horizontal leg 13 of side frame member 11 engages the upper plane surface portion 19 of leg element 18.

The angling of the leg members 16 inwardly from the longitudinal extent of side frame members 11 constitutes an important part of the invention because it eliminates a very common annoying problem of stubbing ones toes on bed frame legs. Unlike ordinary bed frame legs that extend vertically downward from the edge of the bed, legs 16 extend inwardly and below the side frame members to a sufficient degree that the lower ends are cantilevered inwardly and below the side frame so that the floor engaging member is inwardly of the side frame to avoid getting in the way of a person's foot. For this purpose, it has been found that angling the leg member at 45°from the longitudinal extent of cross frame member 12 is sufficient and will locate floor engaging member 35 inwardly of side frame member by a dimension equal to the vertical spacing between cross frame member 12 and floor engaging member 35. Stated another way, a plane P extending through the center of direct connection of leg element 18 and cross frame 12 as well as the center of floor engaging member 35 defines an included angle A with respect to cross frame member 12. This angle A is preferably in the range of 30° to 60°.

As discussed above, leg elements are secured to the ends of the cross frame members 12 by welding an outer flat surface of the leg element 18 to the vertical flat portion 17 of cross frame member 12. The bond between the two elements is made strong enough to withstand downward load forces exerted on side frame members 11 which support the box spring and mattress. Since side frame members 11 abut against the upper surface portion 19 of leg element 18, the downward load forces on side frame member 11 are directly transferred to leg member 16. The bottoms of the leg members 16 carry floor engaging members 35 which, when abutting the floor, provide an upwardly directed reaction force reinforcing the horizontal leg 13 against defection. The floor engaging members 35 may take the form of conventional glides, as shown, or casters may be utilized.

The leg element 18 may include an inwardly struck tongue 18' to support the floor engaging member and in this regard, aligned openings 34 are provided in the bottom wall 27 of the leg element and in tongue 18' for reception of a stem portion 36 of the floor engaging abutment. In the event that tongue 18' is not provided, stem portion 36 may pass directly through a hole in the top wall of the leg element 18.

The side frame and cross frame members, as well as the leg elements associated therewith, are preferably formed from a high-strength, low carbon steel sheet. It has been found that low carbon steel alloys (1018–1025) are well suited for the present invention.

It should also be noted that in addition to providing a structure of unusual strength and which minimizes the possibility of injury, the bed frame of the present invention is improved aesthetically as compared to prior art bed frames. In this regard, because of the inclination of legs 16 and the fact that the lower ends of the legs terminate substantially inwardly of the side frame members, when a box spring and mattress are present on the bed frame, the legs of the bed frame are not visible to a standing viewer giving a bed frame a floating visual effect.

Figure 6:
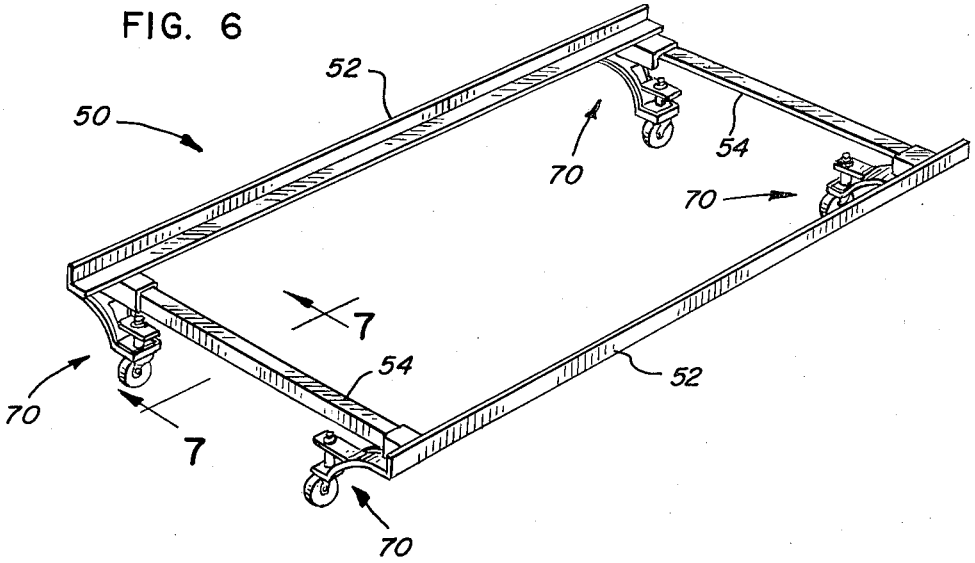
FIG. 6 is a perspective view of a bed frame assembly having a modified form of leg member.
Figure 7:
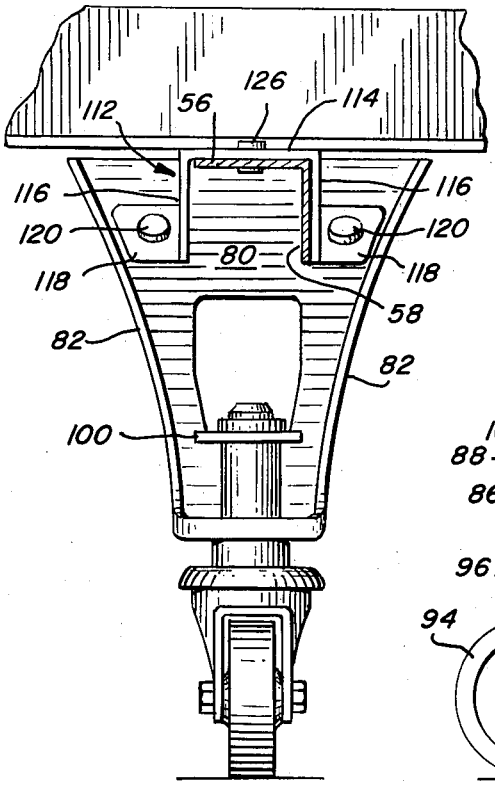
FIG. 7 is a fragmentary sectional view as viewed along line 7—7 of FIG. 6.
Figure 8:
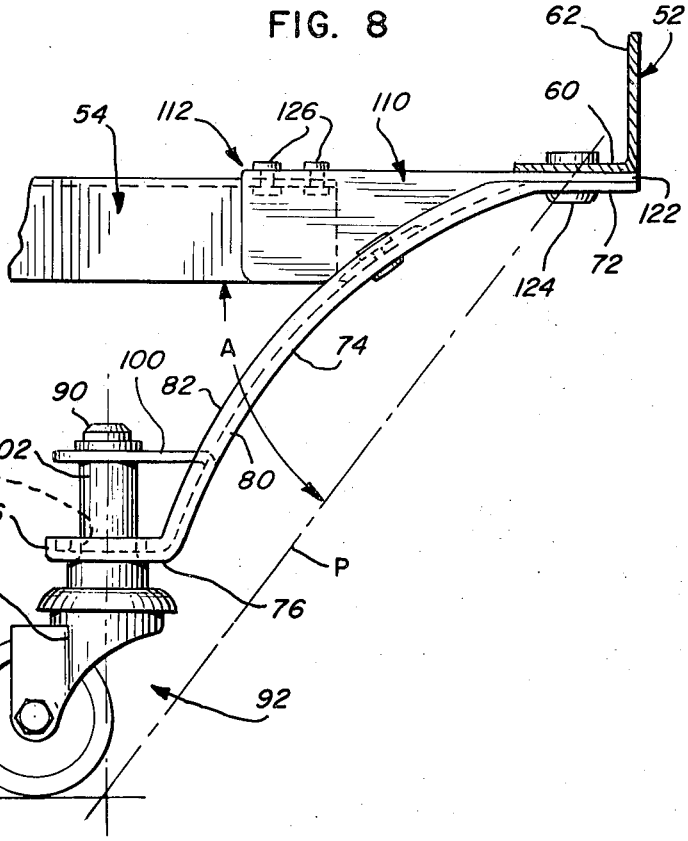
FIG. 8 is a side elevational view of the modified leg member.

FIGS. 6, 7 and 8 illustrate a further modified form of leg member in which the lower ends of the leg members terminate substantially inwardly of the side frame members. Bed frame assembly 50 shown in FIG. 6 includes a pair of spaced elongated side frame members 52 interconnected by a pair of spaced parallel cross frame members 54 that extend generally perpendicular and between the respective side frame members 52. Again, as illustrated in FIG. 1 cross frame members 54 may be of the telescopic type so that the width of the bed frame may readily be adjusted. As illustrated in FIG. 7, cross frame members 54 have a substantially horizontal leg 56 and a substantially vertical leg 58 while side frame members have a substantially identical construction (FIG. 8) consisting of a horizontal leg 60 and a vertical leg 62. Of course, it will be appreciated that side frame members may be configured as illustrated in FIGS. 1–5.

Bed frame 50 defined by side frame members 52 and cross frame members 54 is supported by four leg members 70 respectively located at the junctures between the respective side frame members and cross frame members.

As in the previous embodiment, each leg member is configured so that the lower end portions are cantilevered inwardly and below the side frame members and the floor engaging members supported thereon are located entirely inwardly of the side frame members. In the embodiment illustrated in FIGS. 6–8, each leg member 70 has an upper end portion 72 located directly below horizontal leg 60 of side frame member 52, an arcuate intermediate portion 74 and a lower end portion 76.

As illustrated in FIGS. 7 and 8, intermediate portion 74 consists of a web 80 arcuate in cross section with perpendicular reinforcing flanges 82 extending from opposite edges of web 80.

Upper end portion 72 consists of a flat extension on the upper end of intermediate portion 74 with the extension 72 extending horizontally and parallel to horizontal leg 60 of side frame member 52.

The lower end of leg member 70 is defined by a horizontal integral extension 86 that has an opening 88 therein. The opening 88 receives a stub shaft 90 that forms part of floor engaging member 92, which has been illustrated as a caster wheel 94 fixed to stub shaft 90 by a bracket 96. For additional rigidity, it is preferable that web 80 of intermediate portion 74 of the leg member 70 has a tongue 100 struck therefrom and extending generally parallel to and spaced from horizontal leg 86. A supporting sleeve 102 may be located between leg 60 and tongue 100 to rotatably support stub shaft 90 on leg member 70.

As most clearly shown in FIG. 8, side frame members 52 and cross frame members 54 are interconnected by a unique bracket structure 110. Bracket structure 110 has a generally U-shaped first or inner end 112 (FIG. 7) that has a horizontal web 114 extending above and in contact with horizontal leg 56 of cross frame member 54. U-shaped end portion 112 of bracket 110 also has a pair of depending legs 116 that extend from opposite edges of web 114 with one leg being in contact with the vertical leg 58 of cross member 54. Each leg 116 has an integral outwardly directed lug 118 that is secured to web 80 by a rivet 120.

The opposite end of bracket 110 has a flat planar portion 122 that is located between horizontal leg 60 and flat horizontal upper portion 72 and the three members are interconnected by a connection 124. Also, web portion 114 of the generally U-shaped end of bracket 110 is connected to horizontal leg 56 of cross member 54 by a connection 126.

Preferably, both connections are permanent rivet connections and connection 126 consists of two rivets while connection 124 consists of a single rivet which is positioned so that it defines a pivotal connection between side frame member 52 and cross frame member 54. This will allow the entire assembly to be fully assembled during manufacture and shipped in a collapsed condition. Thus, the purchaser need only pivot the frame members relative to each other to the position shown in FIG. 7 and position a box spring between side frame members 52 which will maintain the assembly in proper position.

Summarizing the modified form of the invention and making particular reference to FIG. 8, it will be noted that each leg member or element 70 has an upper end 72 and a lower end 76 with a floor engaging member 92 supported on the lower end. The upper end 72 defines an upper portion which is connected directly to side frame member 52 by a direct connection, such as rivet 124, so that the upper end is located under the side frame member 52 and the floor engaging member 92 is located substantially inward of the side frame member 52. More specifically, the arcuate intermediate portion of leg element 70 extends inwardly and downwardly a sufficient distance so that each lower end 76 of each of the leg element 70 is cantilevered inwardly and below side frame members 52 as most clearly shown in FIGS. 6 and 8. Also, the configuration and length of arcuate member 74 positions floor engaging member 92 a substantial distance inwardly of the direct connection between side frame members 52 and leg member or element 70. In the embodiment illustrated in FIGS. 7–9, floor engaging members 92 are spaced inwardly from each side frame member by a dimension that is greater than and at least equal to the vertical spacing between floor engaging members 92 and cross frame members 54. Stated another way, as in the previous embodiment, a plane P, which passes through direct connection 124 and the center of the lower end of floor engaging member 92, defines an included angle A with respect to cross frame member 54 and this included angle is in the range of 30° to 60°. In other words, in both embodiments, the leg elements are effectively inclined with respect to the cross frame members. This again gives the bed frame an improved aesthetic appearance and the arcuate configuration will give the bed some "bounce."

What is claimed is:

1. A bed frame comprising: a pair of longitudinally extending parallel side frame members; a pair of spaced parallel cross frame members extending perpendicular between said side frame members and secured thereto; supporting means for said frame, said supporting means including a plurality of leg members secured to said frame at spaced locations, each leg member including a first leg element having an upper end and a lower end with a floor engaging member on the lower end, each leg element having an upper portion fixed to said frame by a direct connection to locate said upper ends under said side frame members and to locate said floor engaging members substantially inwardly of said side frame members, each leg element being inclined with respect to said cross frame members, the included angle of inclination being in the range of 30° to 60°, each leg element extending inwardly and downwardly a sufficient distance so that each said lower end is cantilevered inwardly and below said side frame member and said floor engaging member is located entirely inwardly of said direct connection.

2. A bed frame as set forth in claim 1, in which each first leg element is secured to a cross frame member and in which each leg member includes a second leg element secured to a side frame member and in which said leg elements of each leg member are slidably interconnected to secure said side frame members to said cross frame members.

3. A bed frame as set forth in claim 2, in which said first leg elements are welded to said cross frame members.

4. A bed frame as set forth in claim 2, wherein said first leg elements are tubular members larger in cross section than said second leg elements, and which telescopically receive a second leg element.

5. A bed frame as set forth in claim 4, wherein said first and second leg elements are generally square in cross section and said first and second elements are both tubular members.

6. A bed frame as set forth in claim 1, in which said cross frame members are generally L-shaped in cross section and include a horizontal leg and a flat vertical leg, and wherein said first leg elements have said upper portions in surface-to-surface engagement with a vertical leg and connected to said vertical leg to define said direct connection.

7. A bed frame as set forth in claim 6, wherein each upper portion has two side edges and in which said side edges ae welded to said vertical leg to define said direct connection.

8. A bed frame as set forth in claim 7, wherein the bottom of each upper portion is also welded to said vertical leg.

9. A bed frame as set forth in claim 7, in which the outer ends of said cross frame members are beveled, and wherein said second elements are each welded to one end of a cross frame member and extend inwardly at an angle corresponding to the angle of the bevel of the end of the cross frame member.

10. A bed frame as set forth in claim 1, in which said side frame members are generally L-shaped in cross section and include a flat horizontal leg and a vertical leg, and wherein the upper end of each second element is welded to the lower surface of a horizontal leg.

11. A bed frame as set forth in claim 10, in which said second elements are square in cross section, and wherein at least one side edge of the upper end of each second element is welded to the lower surface of a horizontal leg.

12. A bed frame as set forth in claim 11, wherein opposite side edges of the upper end of each first element are welded to the lower surface of a horizontal leg.

13. A bed frame as set forth in claim 12, wherein the side edges of the upper end of each first element are welded to the lower surface of a horizontal leg by a weld bead which extends continuously along the side edges.

14. A bed frame as defined in claim 1, in which each floor engaging member is spaced inwardly from each side frame member by a dimension that is at least equal to the vertical spacing between each floor engaging member and each cross frame member.

15. A bed frame as defined in claim 14, in which each leg element is arcuate in side elevation between said upper and lower ends.

16. A bed frame as defined in claim 15, further including bracket means connected to each leg element and extending inwardly of said side frame members and connecting means connecting respective ends of said cross frame members to inner ends of the respective bracket means.

17. A bed frame as defined in claim 16, in which each bracket means is substantially U-shaped in cross section at said inner end and having a horizontal web and a pair of spaced depending legs and in which each cross member is generally L-shaped in cross section and has a horizontal leg engaging said web of a bracket means and a vertical leg in engagement with a depending leg.

18. A bed frame as defined in claim 17, in which each bracket means has an outer end flat portion extending a side frame member and an upper portion and in which each direct connection interconnects a side member, flat portion and upper portion.

19. A bed frame comprising: a pair of spaced longitudinally extending parallel side frame members; a pair of spaced parallel cross frame members extending perpendicular to said side frame members; means for securing said side frame members to the ends of said cross members and for supporting said frame; each securing and supporting means comprising a hollow first element secured to a cross frame member and a second element secured to a side frame member at an end thereof; said first and second elements each being rectilinear and extending downwardly from said frame and inwardly of said side frame members at an acute angle with respect to said cross frame members said second elements being telescopingly received into said first elements to secure said side frame members to said cross frame members; each securing and supporting means extending inwardly and downwardly a sufficient distance to locate the lower end thereof inwardly and below a side frame member and floor engaging means connected to the lower end of each securing and supporting means and engaging the floor at a location inset from said side frame members.

20. A bed frame as defined in claim 19, in which said cross frame members are each generally L-shaped in cross section and include a horizontal leg and a flat vertical leg and in which said first elements each include a flat mounting portion in engagement with a vertical leg.

21. A bed frame as defined in claim 20, in which said side frame members each include a flat horizontal leg and a vertical leg and in which the upper end of each second element is welded to a lower surface of a horizontal leg.

22. A bed frame as defined in claim 20, in which said first elements are welded to said vertical legs.

23. A bed frame comprising: a pair of spaced longitudinally extending parallel, side frame members; a pair of spaced parallel cross frame members extending perpendicular to said side frame members; means for securing said side frame members to the ends of said cross members; a plurality of leg elements secured to said frame at spaced locations, each leg element having an upper end secured to a side frame member by a direct connection to locate said upper ends under said side frame members and each leg element having a floor engaging member secured to a lower end, each leg element having an arcuate intermediate portion to locate said floor engaging members substantially inwardly of and below said side frame members, said floor engaging members each being located inwardly of its said direct connection.

24. A bed frame as defined in claim 23, in which said means for securing includes bracket means connected to respective ends of said cross frame members and in which the respective leg elements and bracket means are secured to said side frame members by a rivet which also defines a pivotal connection between said side frame members and said cross frame members.

* * * * *